US007977574B2

(12) United States Patent
Cases et al.

(10) Patent No.: US 7,977,574 B2
(45) Date of Patent: Jul. 12, 2011

(54) CABLE FOR HIGH SPEED DATA COMMUNICATIONS

(75) Inventors: Moises Cases, Austin, TX (US); Daniel N. De Araujo, Cedar Park, TX (US); Bhyrav M. Mutnury, Austin, TX (US); Bruce J. Wilkie, Georgetown, TX (US)

(73) Assignee: International Business Machines Corporation, Armonk, NY (US)

( * ) Notice: Subject to any disclaimer, the term of this patent is extended or adjusted under 35 U.S.C. 154(b) by 126 days.

(21) Appl. No.: 12/265,407

(22) Filed: Nov. 5, 2008

(65) Prior Publication Data

US 2010/0108350 A1 May 6, 2010

(51) Int. Cl.
*H01B 7/00* (2006.01)

(52) U.S. Cl. ..... 174/102 R

(58) Field of Classification Search ..... 174/102 R, 174/102 D, 113 R, 108
See application file for complete search history.

(56) References Cited

U.S. PATENT DOCUMENTS

| | | | | |
|---|---|---|---|---|
| 840,766 | A * | 1/1907 | Greenfield | 138/135 |
| 4,323,721 | A | 4/1982 | Kincaid et al. | |
| 4,497,533 | A | 2/1985 | Genova et al. | |
| 4,691,081 | A * | 9/1987 | Gupta et al. | 174/105 R |
| 4,912,283 | A | 3/1990 | O'Connor | |
| 6,566,606 | B1 | 5/2003 | Hazy et al. | |
| 2002/0150742 | A1 | 10/2002 | Ragland et al. | |
| 2004/0026101 | A1 * | 2/2004 | Ochi | 174/36 |
| 2004/0166296 | A1 | 8/2004 | Ragland et al. | |

* cited by examiner

*Primary Examiner* — Chau N Nguyen
(74) *Attorney, Agent, or Firm* — Brandon C. Kennedy; Cynthia G. Seal; Biggers & Ohanian, LLP.

(57) ABSTRACT

Cables and methods of manufacturing cables for high speed data communications, the cable including: a first inner conductor enclosed by a first dielectric layer and a second inner conductor enclosed by a second dielectric layer, the inner conductors and the dielectric layers parallel with and along a longitudinal axis; and folded conductive shield material wrapped in a rotational direction along and about the longitudinal axis around the inner conductors and the dielectric layers, including overlapped wraps along and about the longitudinal axis, the conductive shield material comprising a first conductive layer and second conductive layer separated by an inner-shield dielectric layer.

15 Claims, 6 Drawing Sheets

CABLE FOR HIGH SPEED DATA COMMUNICATIONS

BACKGROUND OF THE INVENTION

1. Field of the Invention

The field of the invention is data processing, or, more specifically, cables and methods of manufacturing cables for high speed data communications.

2. Description of Related Art

High speed data communications over shielded cables are an important component to large high-end servers and digital communications systems. While optical cables provide long distance drive capability, copper cables are typically preferred in environments that require a shorter distance cable due to a significant cost savings opportunity. A typical copper cable used in environments requiring a shorter distance cable, is a twinaxial cable. A twinaxial cable is a coaxial cable that includes two insulated, inner conductors and a shield wrapped around the insulated inner conductors. Twinaxial cables are used for half-duplex, balanced transmission, high-speed data communications. In current art however, twinaxial cables used in data communications environments are limited in performance due to a bandstop effect.

For further explanation of typical twinaxial cables, therefore, FIG. 1 sets forth a perspective view of a typical twinaxial cable (100). The exemplary typical twinaxial cable (100) of FIG. 1 includes two conductors (106, 108) and two dielectrics (110, 112) surrounding the conductors. The conductors (106, 108) and the dielectrics (110, 112) are generally parallel to each other and a longitudinal axis (105).

The typical twinaxial cable (100) of FIG. 1 also includes a shield (114). The shield, when wrapped around the conductors of a cable, acts as a Faraday cage to reduce electrical noise from affecting signals transmitted on the cable and to reduce electromagnetic radiation from the cable that may interfere with other electrical devices. The shield also minimizes capacitively coupled noise from other electrical sources, such as nearby cables carrying electrical signals. The shield (114) is wrapped around the conductors (106, 108). The shield (114) includes wraps (101-103) along and about the longitudinal axis (105), each wrap overlapping the previous wrap. A wrap is a 360 degree turn of the shield around the longitudinal axis (105). The typical twinaxial cable of FIG. 1 includes three wraps (101-103), but readers of skill in the art will recognize that the shield may be wrapped around the inner conductors and the dielectric layers any number of times in dependence upon the length of the cable. Wrap (101) is shaded for purposes of explanation. Each wrap (101-103) overlaps the previous wrap. That is, wrap (101) is overlapped by wrap (102) and wrap (102) is overlapped by wrap (103). The overlap (104) created by the overlapped wraps is continuous along and about the longitudinal axis (105) of the cable (100).

The wraps (101-103) of the shield (114) create an overlap (104) of the shield that forms an electromagnetic bandgap structure ('EBG structure') that acts as the bandstop filter. An EBG structure is a periodic structure in which propagation of electromagnetic waves is not allowed within a stopband. A stopband is a range of frequencies in which a cable attenuates a signal. In the cable of FIG. 1, when the conductors (106, 108) carry current from a source to a load, part of the current is returned on the shield (114). Due to skin effect, the current in the conductors to the load displaces on the outer surface of the conductor, and the current return path attempts to run parallel to, but in the opposite direction of, the current to the load. As such, the current on the shield (114) encounters the overlap (104) of the shield (104) periodically and a discontinuity exists in the current return path due to the overlap. The discontinuity in the current return path at the overlap (104) created by the wraps (101-103) acts as a bandstop filter that attenuates signals at frequencies in a stopband.

For further explanation, FIG. 2 sets forth a cross-sectional view of a prior art data communications cable (100), similar to a twinaxial cable. The cable (100) in the example of FIG. 2 only depicts a single conductor (108) for clarity of explanation only, but readers of skill in the art will immediately recognize that two or more conductors may be present in such a cable. The typical twinaxial cable of FIG. 2 includes a shield (114), surrounding a conductor (108) insulated with a dielectric layer (109). Current (204) in the example of FIG. 2 is flowing in the conductor (108) on the 'skin' or outer-edge of the conductor (108) while the return current (208) flows in the opposite direction along the conductive shield (114). The shield (114) includes two conductive layers (206) separated by a dielectric layer. The current return path, attempting to run parallel to the current (204) in the conductor, travels from right to left as depicted by the repeating arrows, and must 'jump' the dielectric layers (208) of the shield (114) to flow closer to the 'skin' of the conductor. Such a 'jump' creates a capacitance, two charged plates separated by a dielectric medium, which periodically repeats along the length of the cable. The cable also has some internal inductance due to various factors, including the repetitive wrapping of a conductive shield around the conductor (108).

For further explanation, therefore, FIG. 3 sets forth a graph of the insertion loss of a typical twinaxial cable. Insertion loss is the signal loss in a cable that results from inserting the cable between a source and a load. The insertion loss depicted in the graph of FIG. 3 is the insertion loss of a typical twinaxial cable, such as the twinaxial cable described above with respect to FIG. 1. In the graph of FIG. 3, the signal (119) is attenuated (118) within a stopband (120) of frequencies (116) ranging from seven to nine gigahertz ('GHz'). The stopband (120) has a center frequency (121) that varies in dependence upon the composition of the shield, the width of the shield, and the rate that the shield is wrapped around the conductors and dielectrics. The center frequency (121) of FIG. 3 is 8 GHz.

The attenuation (118) of the signal (119) in FIG. 3 peaks at approximately −60 decibels ('dB') for signals with frequencies (116) in the range of approximately 8 GHz. The magnitude of the attenuation (118) of the signal (119) is dependent upon the length of the cable. The effect of the EBG structure, the attenuation of a signal, increases as the length of the EBG structure increases. A longer cable having a wrapped shield has a longer EBG structure and, therefore, a greater attenuation on a signal than a shorter cable having a shield wrapped at the same rate. That is, the longer the cable, the greater the attenuation of the signal. In addition to signal attenuation, the bandstop effect also increases other parasitic effects in the cable, such as jitter and the like.

Typical twinaxial cables for high speed data communications, therefore, have certain drawbacks. Typical twinaxial cables have a bandstop filter created by overlapped wraps of a shield that attenuates signals at frequencies in a stopband. The attenuation of the signal increases as the length of the cable increases. The attenuation limits data communications at frequencies in the stopband.

SUMMARY OF THE INVENTION

Cables and methods of manufacturing cables for high speed data communications, the cable including: a first inner conductor enclosed by a first dielectric layer and a second inner conductor enclosed by a second dielectric layer, the inner conductors and the dielectric layers parallel with and along a longitudinal axis; and folded conductive shield material wrapped in a rotational direction along and about the longitudinal axis around the inner conductors and the dielectric layers, including overlapped wraps along and about the longitudinal axis, the conductive shield material comprising a first conductive layer and second conductive layer separated by an inner-shield dielectric layer.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXEMPLARY EMBODIMENTS

Figure 1:
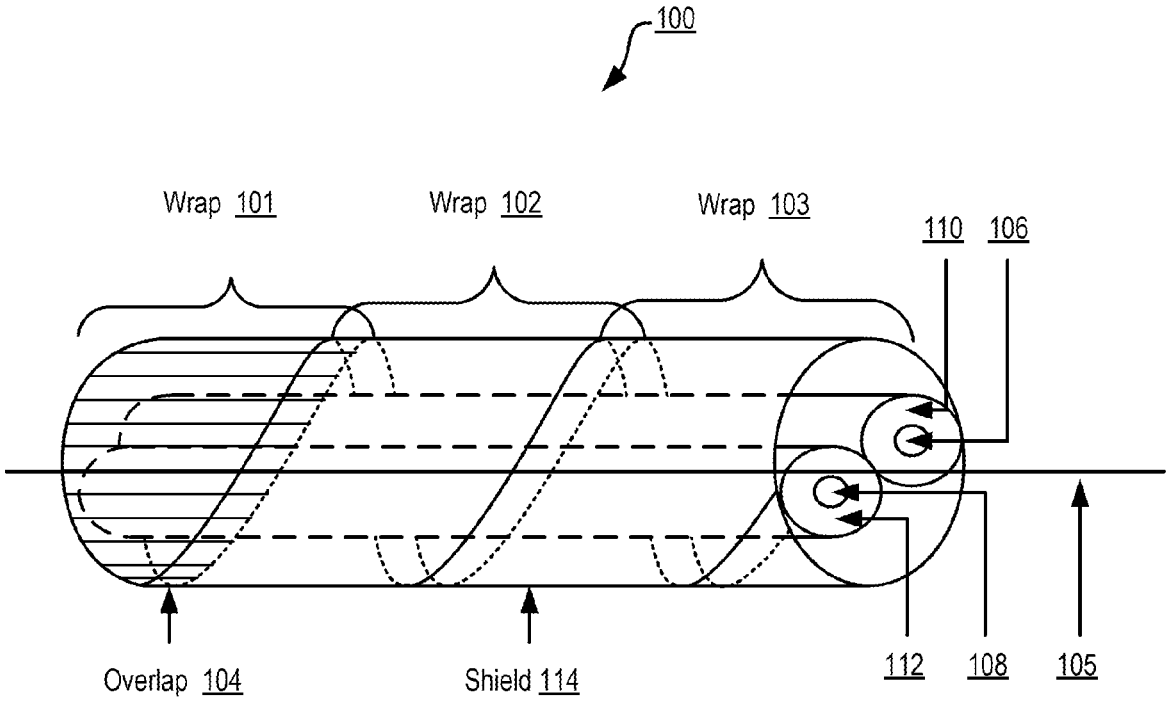
PRIOR ART FIG. 1
FIG. 1 sets forth a perspective view of a typical twinaxial cable.
Figure 2:
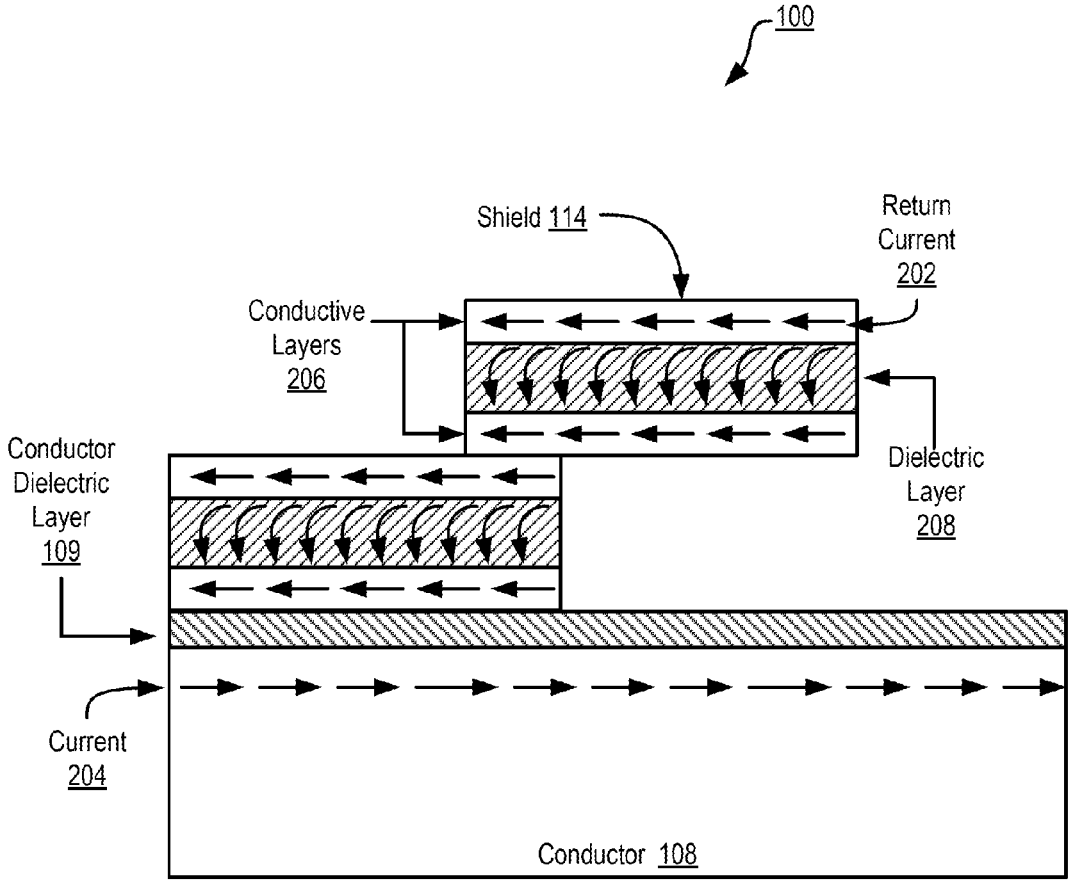
PRIOR ART FIG. 2
FIG. 2 sets forth a cross-sectional view of a prior art data communications cable.
Figure 3:
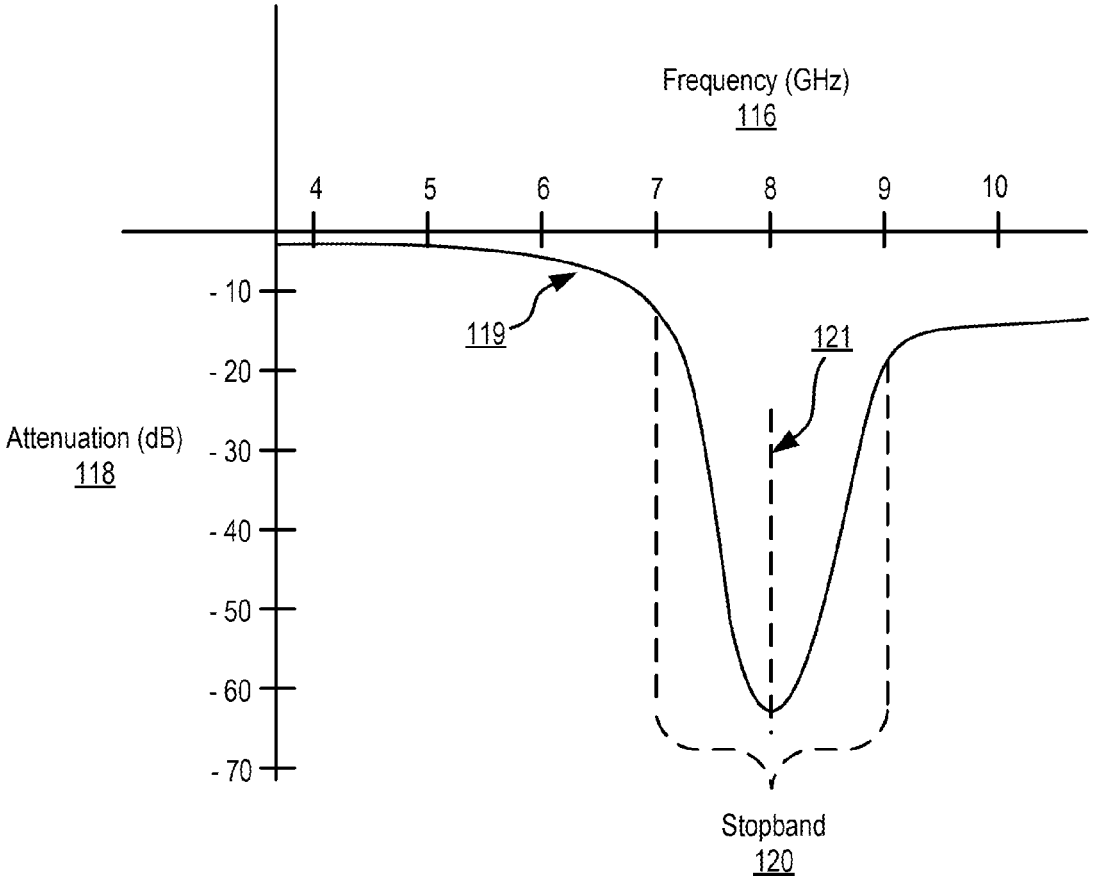
PRIOR ART FIG. 3
FIG. 3 sets forth a graph of the insertion loss of a typical twinaxial cable.
Figure 4:
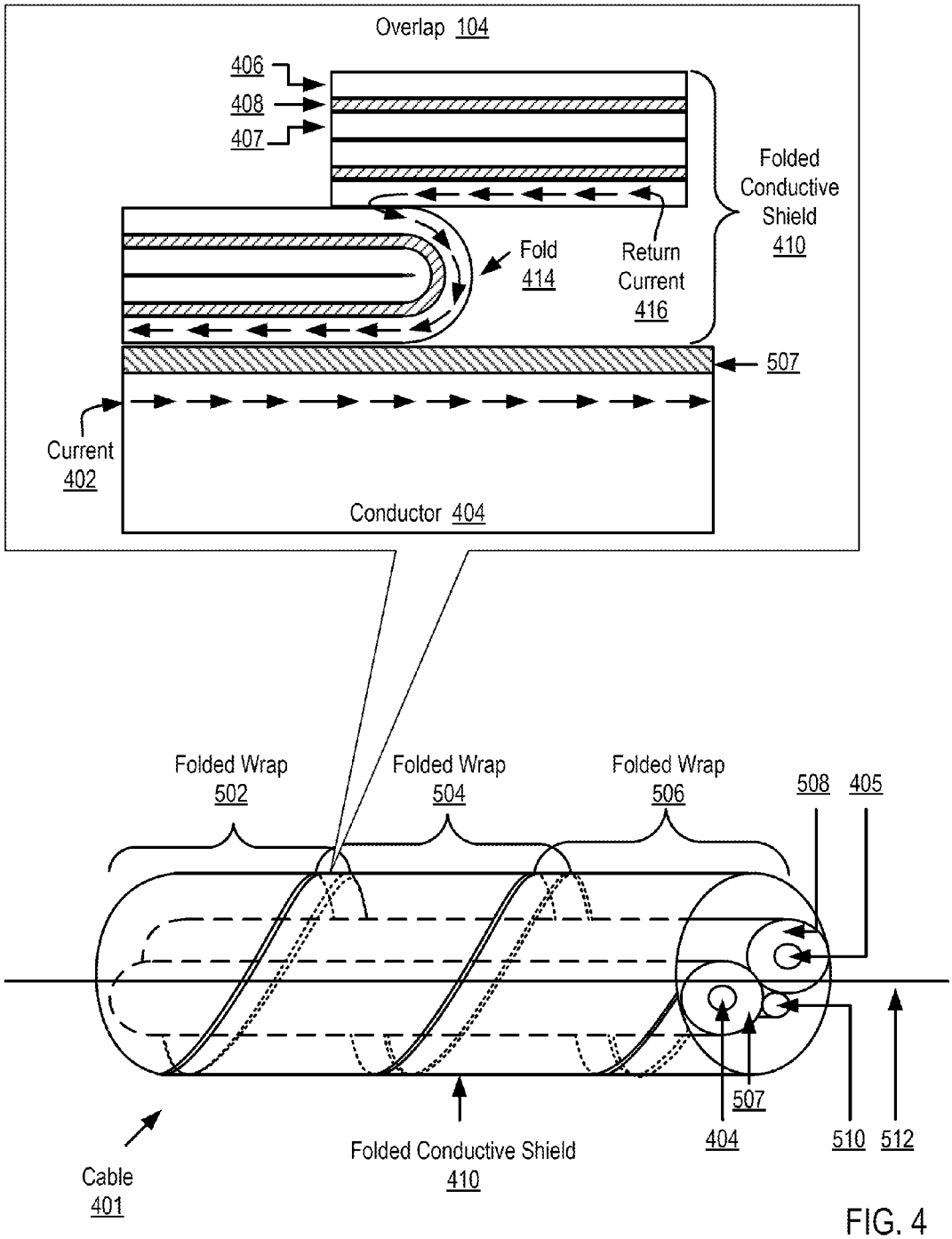
FIG. 4 sets forth a perspective view of a data communications cable for high speed data communications according to embodiments of the present invention.

Exemplary cables and methods of manufacturing cables for high speed data communications in accordance with embodiments of the present invention are described with reference to the accompanying drawings, beginning with FIG. 4. FIG. 4 sets forth a perspective view of a data communications cable (401) for high speed data communications according to embodiments of the present invention.

The cable (401) of FIG. 4 includes a first inner conductor (404) enclosed by a first dielectric layer (507) and a second inner conductor (405) enclosed by a second dielectric layer (508). The inner conductors (404, 408) and dielectric layers (507, 508) are parallel with and along a longitudinal axis (512). Although the cable (401) is described here as including only two inner conductors, readers of skill in the art will immediately recognize that cables for high speed data communications according to embodiments of the present invention may include any number of inner conductors. In the cable (401) of FIG. 4, the inner conductors (404, 405) also include an optional drain conductor (510). A drain conductor is a non-insulated conductor electrically connected to the earth potential ('ground') and typically electrically connected to conductive shield material (410) also referred to here as the 'conductive shield (410)' or the 'folded conductive shield (410). Two inner conductors and a drain are depicted in the example cable (401) of FIG. 4 for clarity only, not limitation. Readers of skill in the art will immediately recognize that cables (401) configured according to embodiments of the present invention for high speed data communications may include any number of inner conductors as well as no drain at all.

The conductive shield (410) in the example cable (401) of FIG. 4 is folded and wrapped in a rotational direction along and about the longitudinal axis (512) around the inner conductors (404, 405) and the dielectric layers (507, 508), The folded conductive shield (410) including overlapped wraps (502, 504, 506) along and about the longitudinal axis (512).

One overlap (104) is expanded for clarity of explanation in the example of FIG. 4. The expanded view of the overlap (104) includes a cross-sectional view of the cable (401) at an overlap of the wrapped conductive shield (410). As depicted in the expanded overlap (104), the conductive shield material (410) includes a first conductive layer (406) and second conductive layer (407) separated by an inner-shield dielectric layer (408). The conductive shield material depicted in the expanded overlap (104) of FIG. 4 is folded (414). The fold (414) in the conductive shield provides a continuous current return path that reduces attenuation of signals having frequencies in a stopband of a stopband filter created by discontinuities in current return paths of unfolded, wrapped conductive shields, as described above with respect to prior art cables. That is, return current (416) traveling along the conductive shield (410) experiences no discontinuities, but instead travels from conductive layer to conductive layer, parallel with, in the opposite direction of, and near the path of the current (402) traveling in the conductor (404) reducing, if not eliminating bandstop effects that would otherwise be present in the cable. The conductor (404) in the expanded overlap (104) of FIG. 4 is separated from the conductive shield material by an insulated dielectric layer (507). In the example cable (401) of FIG. 4, such a stopband may be characterized by a center frequency in the range of 5-10 gigahertz ('GHz'). That is, without folding the conductive shield material, signals having a frequency from 5-10 GHz are attenuated, but with the fold (414), such signals are not attenuated due to the continuous current return path created in the conductive shield material.

The cable (401) in the example of FIG. 4 may also include an outer, non-conductive layer that encloses the conductive shield material (410) and the first and second inner conductors (404, 405), that is, every component of the cable. The non-conductive layer may be any insulating jacket useful in cables for high speed data communications as will occur to those of skill in the art. Such a jacket may be formed of plastic, rubber, cloth, or other non-conductive material.

Figure 5:
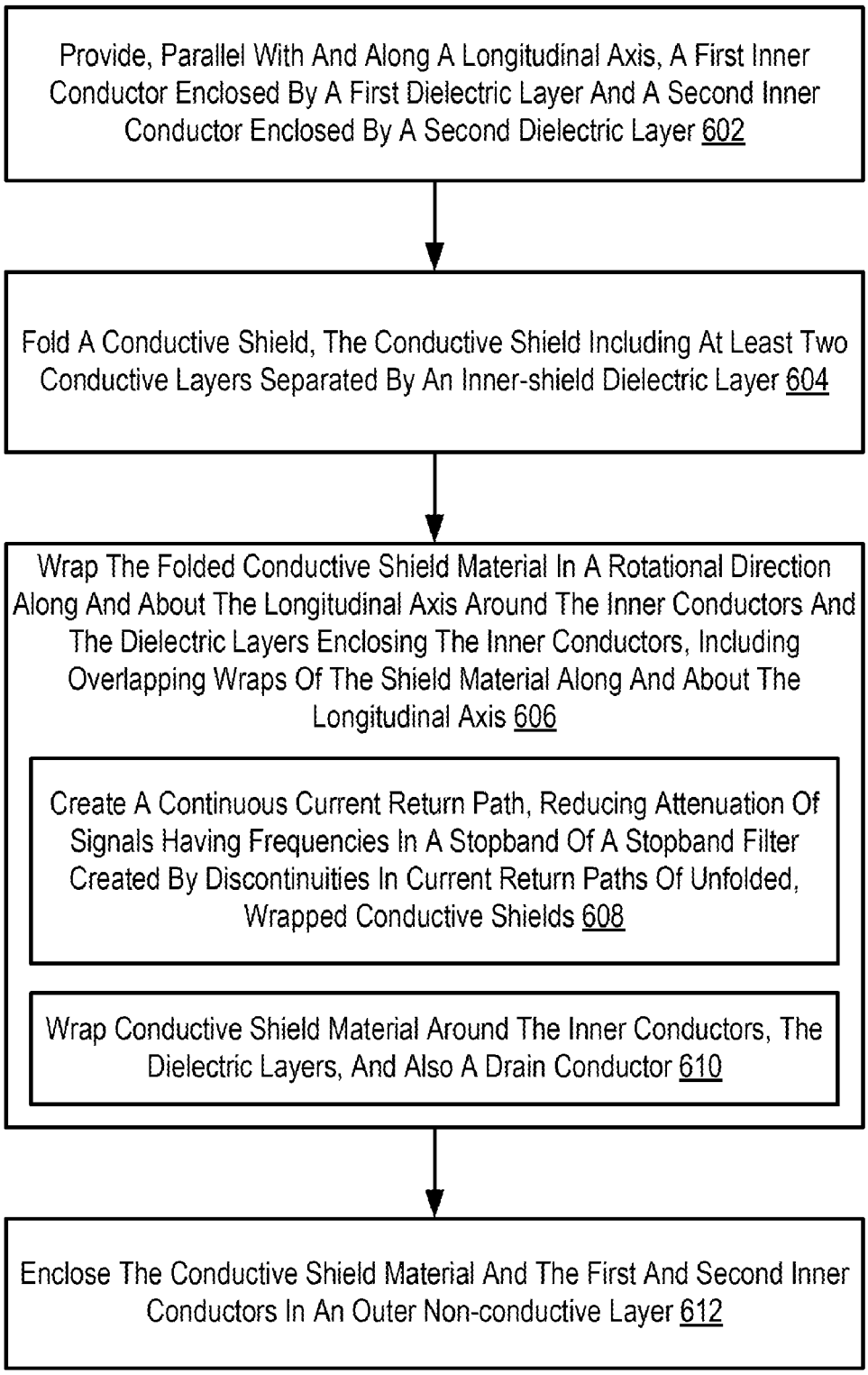
FIG. 5 sets forth a flow chart illustrating an exemplary method for manufacturing a cable for high speed data communications according to embodiments of the present invention.

For further explanation, FIG. 5 sets forth a flow chart illustrating an exemplary method for manufacturing a cable for high speed data communications according to embodiments of the present invention. The method of FIG. 5 includes providing (602), parallel with and along a longitudinal axis, a first inner conductor enclosed by a first dielectric layer and a second inner conductor enclosed by a second dielectric layer. The method of FIG. 5 also includes folding (604) a conductive shield, the conductive shield comprising at least two conductive layers separated by an inner-shield dielectric layer.

The method of FIG. 5 also includes wrapping (606) the folded conductive shield material in a rotational direction along and about the longitudinal axis around the inner conductors and the dielectric layers enclosing the inner conductors, including overlapping wraps of the shield material along and about the longitudinal axis. In the method of FIG. 5 wrapping (606) the folded conductive shield material in a rotational direction along and about the longitudinal axis around the inner conductors and the dielectric layers enclosing the inner conductors includes creating (608) a continuous current return path, reducing attenuation of signals having frequencies in a stopband of a stopband filter created by discontinuities in current return paths of unfolded, wrapped conductive shields.

Wrapping (606) the folded conductive shield material in a rotational direction along and about the longitudinal axis around the inner conductors and the dielectric layers enclosing the inner conductors, in the method of FIG. 5 also includes wrapping (610) conductive shield material around the inner conductors, the dielectric layers, and also a drain conductor.

The method of FIG. 5 also includes enclosing (612) the conductive shield material and the first and second inner conductors in an outer non-conductive layer. The non-conductive layer may be any insulating jacket useful in cables for high speed data communications as will occur to those of skill in the art. Such a jacket may be formed of plastic, rubber, cloth, or other non-conductive material.

Figure 6:
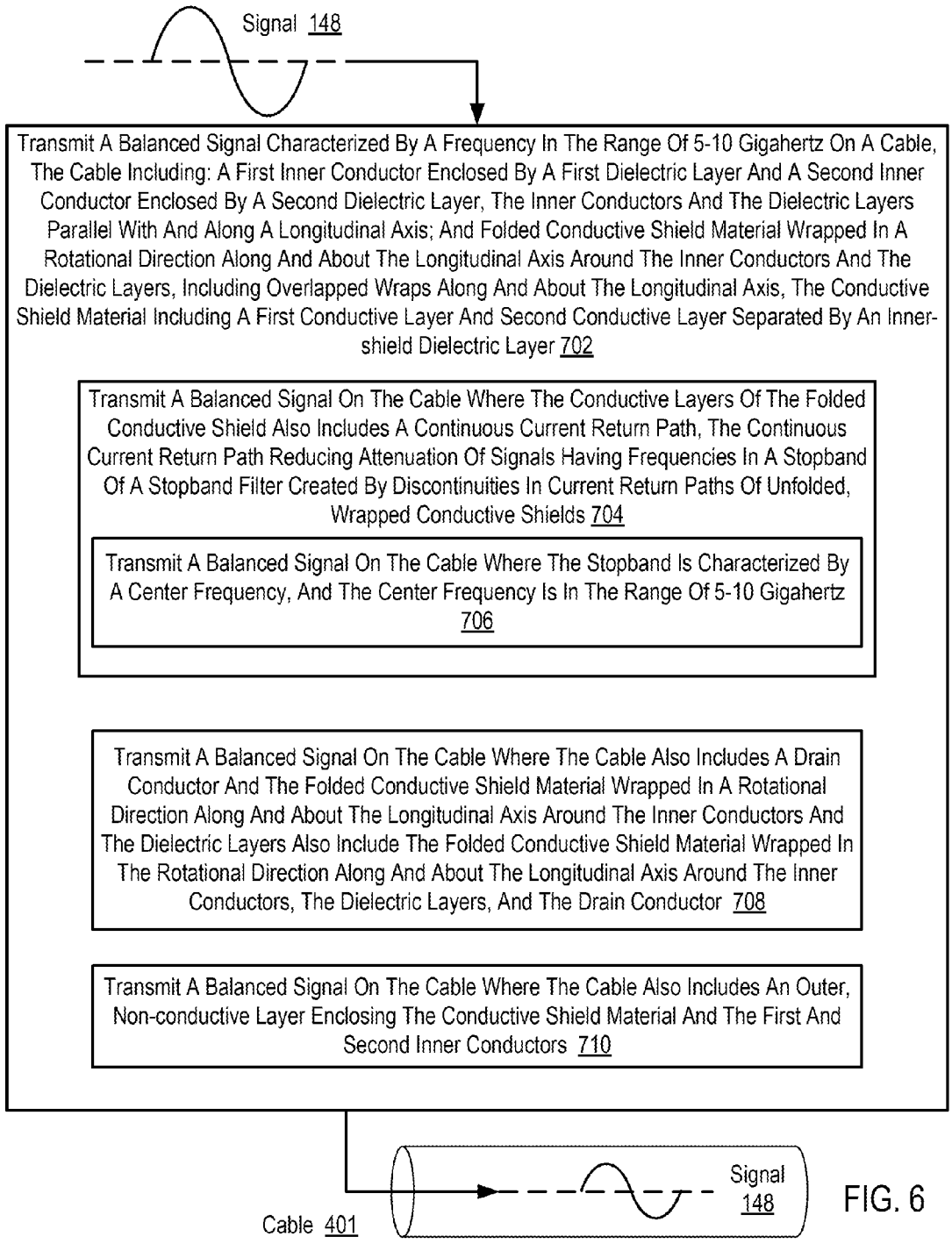
FIG. 6 sets forth a flow chart illustrating an exemplary method of transmitting a signal on a cable for high speed data communications according to embodiments of the present invention.

For further explanation, FIG. 6 sets forth a flow chart illustrating an exemplary method of transmitting a signal on a cable for high speed data communications according to embodiments of the present invention. The method of FIG. 6 includes transmitting (702) a balanced signal (148) characterized by a frequency in the range of 5-10 gigahertz on a cable (401). The cable includes a first inner conductor enclosed by a first dielectric layer and a second inner conductor enclosed by a second dielectric layer, the inner conductors and the dielectric layers parallel with and along a longitudinal axis. The cable also includes folded conductive shield material wrapped in a rotational direction along and about the longitudinal axis around the inner conductors and the dielectric layers, including overlapped wraps along and about the longitudinal axis, the conductive shield material comprising a first conductive layer and second conductive layer separated by an inner-shield dielectric layer.

In the method of FIG. 6, transmitting (702) a balanced signal (148) on the cable (401) includes transmitting (704) a balanced signal (148) on the cable where the conductive layers of the folded conductive shield further comprise a continuous current return path, the continuous current return path reducing attenuation of signals having frequencies in a stopband of a stopband filter created by discontinuities in current return paths of unfolded, wrapped conductive shields. In the method of FIG. 6, transmitting (704) a balanced signal (148) on the cable where the conductive layers of the folded conductive shield further comprise a continuous current return path, the continuous current return path reducing attenuation of signals having frequencies in a stopband of a stopband filter created by discontinuities in current return paths of unfolded, wrapped conductive shields includes transmitting a balanced signal on the cable where the stopband is characterized by a center frequency and the center frequency is in the range of 5-10 gigahertz.

In the method of FIG. 6, transmitting (702) a balanced signal (148) on the cable (401) includes transmitting (708) a balanced signal (148) on the cable where the cable (401) also includes a drain conductor and the folded conductive shield material is wrapped in the rotational direction along and about the longitudinal axis around the inner conductors, the dielectric layers, and the drain conductor. In the method of FIG. 6, transmitting (702) a balanced signal (148) on the cable (401) includes transmitting (708) a balanced signal (148) on the cable where the cable also includes an outer, non-conductive layer enclosing the conductive shield material and the first and second inner conductors.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A method of manufacturing a cable for high speed data communications, the method comprising:

providing, parallel with and along a longitudinal axis, a first inner conductor enclosed by a first dielectric layer and a second inner conductor enclosed by a second dielectric layer;

folding a conductive shield material, the conductive shield material comprising at least two conductive layers separated by an inner-shield dielectric layer; and wrapping the folded conductive shield material in a rotational direction along and about the longitudinal axis around the inner conductors and the dielectric layers enclosing the inner conductors, including overlapping wraps of the shield material along and about the longitudinal axis, including creating, with the conductive layers of the folded conductive shield material, a continuous current return path for the inner conductors.

2. The method of claim 1 wherein wrapping the folded conductive shield material along and about the longitudinal axis further comprises:

reducing attenuation of signals having frequencies in a stopband of a stopband filter created by discontinuities in current return paths of unfolded, wrapped conductive shields.

3. The method of claim 2 wherein the stopband is characterized by a center frequency and the center frequency is in the range of 5-10 gigahertz.

4. The method of claim 1 wherein:

wrapping the folded conductive shield material in a rotational direction along and about the longitudinal axis around the inner conductors and the dielectric layers enclosing the inner conductors further comprises wrapping conductive shield material around the inner conductors, the dielectric layers, and also a drain conductor.

5. The method of claim 1 further comprising:

enclosing the conductive shield material and the first and second inner conductors in an outer non-conductive layer.

6. A cable for high speed data communications, the cable comprising:

a first inner conductor enclosed by a first dielectric layer and a second inner conductor enclosed by a second dielectric layer, the inner conductors and the dielectric layers parallel with and along a longitudinal axis; and folded conductive shield material wrapped in a rotational direction along and about the longitudinal axis around the inner conductors and the dielectric layers, including overlapped wraps along and about the longitudinal axis, the conductive shield material comprising a first conductive layer and second conductive layer separated by an inner-shield dielectric layer, the conductive layers of the folded conductive shield comprising a continuous current return path for the inner conductors.

7. The cable of claim 6 wherein the continuous current return path reduces attenuation of signals having frequencies in a stopband of a stopband filter created by discontinuities in current return paths of unfolded, wrapped conductive shields.

8. The cable of claim 7 wherein the stopband is characterized by a center frequency and the center frequency is in the range of 5-10 gigahertz.

9. The cable of claim 6 further comprising a drain conductor, wherein:

the folded conductive shield material wrapped in a rotational direction along and about the longitudinal axis around the inner conductors and the dielectric layers further comprises the folded conductive shield material wrapped in the rotational direction along and about the longitudinal axis around the inner conductors, the dielectric layers, and the drain conductor.

10. The cable of claim 6 further comprising:

an outer, non-conductive layer enclosing the conductive shield material and the first and second inner conductors.

11. A method of transmitting a signal on a cable for high speed data communications, the method comprising:

transmitting a balanced signal characterized by a frequency in the range of 5-10 gigahertz on a cable, the cable comprising:

a first inner conductor enclosed by a first dielectric layer and a second inner conductor enclosed by a second dielectric layer, the inner conductors and the dielectric layers parallel with and along a longitudinal axis; and folded conductive shield material wrapped in a rotational direction along and about the longitudinal axis around the inner conductors and the dielectric layers, including overlapped wraps along and about the longitudinal axis, the conductive shield material comprising a first conductive layer and second conductive layer separated by an inner-shield dielectric layer, the conductive layers of the folded conductive shield comprising a continuous current return path for the inner conductors.

12. The method of claim 11 wherein the continuous current return path reduces attenuation of signals having frequencies in a stopband of a stopband filter created by discontinuities in current return paths of unfolded, wrapped conductive shields.

13. The method of claim 12 wherein the stopband is characterized by a center frequency and the center frequency is in the range of 5-10 gigahertz.

14. The method of claim 11 wherein:

the cable further comprises a drain conductor; and the folded conductive shield material wrapped in a rotational direction along and about the longitudinal axis around the inner conductors and the dielectric layers further comprises the folded conductive shield material wrapped in the rotational direction along and about the longitudinal axis around the inner conductors, the dielectric layers, and the drain conductor.

15. The method of claim 11 wherein the cable further comprises:

an outer, non-conductive layer enclosing the conductive shield material and the first and second inner conductors.

* * * * *